US009771890B2

(12) United States Patent
Hwang

(10) Patent No.: US 9,771,890 B2
(45) Date of Patent: Sep. 26, 2017

(54) OIL PASSAGE FOR SUPPLYING OIL

(71) Applicant: Hyundai Motor Company, Seoul (KR)

(72) Inventor: Gyu Han Hwang, Yongin-Si (KR)

(73) Assignee: Hyundai Motor Company, Seoul (KR)

( * ) Notice: Subject to any disclaimer, the term of this patent is extended or adjusted under 35 U.S.C. 154(b) by 237 days.

(21) Appl. No.: 14/517,610

(22) Filed: Oct. 17, 2014

(65) Prior Publication Data

US 2015/0167582 A1 Jun. 18, 2015

(30) Foreign Application Priority Data

Dec. 17, 2013 (KR) ..... 10-2013-0157536

(51) Int. Cl.

| | |
|---|---|
| ***F01L 9/02*** | (2006.01) |
| ***F01L 1/14*** | (2006.01) |
| ***F02F 1/42*** | (2006.01) |
| ***F02F 1/36*** | (2006.01) |
| ***F01M 3/04*** | (2006.01) |
| ***F02F 1/24*** | (2006.01) |
| ***F01L 13/00*** | (2006.01) |

(52) U.S. Cl.

CPC ..... *F02F 1/36* (2013.01); *F01L 13/0005* (2013.01); *F01M 3/04* (2013.01); *F02F 1/24* (2013.01); *F01L 2013/001* (2013.01)

(58) Field of Classification Search

CPC ... F01L 9/02; F01L 9/021; F01L 25/02; F01L 2001/34446; F01L 1/267; F01L 13/0005; F01L 2013/001; F02F 1/36; F02F 1/24; F01M 3/04

USPC ..... 123/90.12–90.57, 193.3, 193.5

See application file for complete search history.

(56) References Cited

U.S. PATENT DOCUMENTS

| | | | | |
|---|---|---|---|---|
| 3,033,314 A * | 5/1962 | Wetterhahn | ..... | F01M 1/06 184/6.9 |
| 6,739,294 B1 * | 5/2004 | Liedtke | ..... | F01L 9/02 123/195 R |
| 2002/0157623 A1 * | 10/2002 | Turner | ..... | F01L 9/02 123/90.12 |

(Continued)

FOREIGN PATENT DOCUMENTS

| | | |
|---|---|---|
| JP | 2005-048882 A | 2/2005 |
| JP | 2010-071221 A | 4/2010 |

(Continued)

*Primary Examiner* — Syed O Hasan

(74) *Attorney, Agent, or Firm* — Morgan, Lewis & Bockius LLP

(57) ABSTRACT

An oil passage which supplies hydraulic oil to a cylinder deactivation apparatus (CDA) that operates by hydraulic pressure may include a high pressure passage, a low pressure passage, and an orifice, all of which may be integrally formed in either a cylinder head or a cam carrier. The high pressure passage may be connected to an oil supply apparatus and receive oil therefrom. The low pressure passage may be coupled to the high pressure passage and receive pressurized oil therefrom and form a low pressure relatively lower than a pressure in the high pressure passage. The low pressure passage may be connected to supply a hydraulic pressure to the CDA. The orifice may couple the high pressure passage to the low pressure passage, communicate the high pressure passage and the low pressure passage and may be formed to supply oil from the high pressure passage to the low pressure passage.

7 Claims, 4 Drawing Sheets

(56) References Cited

U.S. PATENT DOCUMENTS

| | | | | |
|---|---|---|---|---|
| 2008/0135003 | A1* | 6/2008 | Lee | F01L 1/143<br>123/90.17 |
| 2009/0205601 | A1* | 8/2009 | Baker | F01L 1/053<br>123/90.57 |

FOREIGN PATENT DOCUMENTS

| | | | |
|---|---|---|---|
| KR | 10-0836927 | B1 | 6/2008 |
| KR | 10-2012-0003528 | A | 11/2012 |

* cited by examiner

OIL PASSAGE FOR SUPPLYING OIL

CROSS-REFERENCE TO RELATED APPLICATION

This application claims priority to Korean Patent Application No. 10-2013-0157536 filed Dec. 17, 2013, the entire contents of which is incorporated herein for all purposes by this reference.

BACKGROUND OF THE INVENTION

Field of the Invention

The present invention relates to an oil passage for supplying oil, and more particularly to an oil passage for supplying oil that deactivates an engine cylinder.

Description of Related Art

Generally speaking, an internal combustion engine has features where a gas mixture is combusted in a combustion chamber, and it is operated by energy generated by combustion heat. The above-mentioned internal combustion engine mainly uses a multiple-cylinder engine equipped with a plurality of cylinders to increase the output of an engine and to reduce noise and vibration.

In recent years, due to increasing energy cost, a cylinder deactivation apparatus (CDA) is being developed, which cylinder deactivation apparatus (CDA) is configured to improve fuel consumption by deactivating part of the cylinders installed in an engine when the engine operates in a low horsepower state.

For example, if the cylinder deactivation apparatus (CDA) is provided for a 4-cylinder engine, a gas mixture is not supplied to two cylinders so that they cannot be ignited. For this, the engine is operated by only the remaining two cylinders. In the cylinder deactivation apparatus (CDA), there is included a hydraulic lash adjuster (HLA) that is configured to adjust a gap of each valve using a hydraulic pressure, by means of which an intake valve is closed irrespective of the rotation of a camshaft when the input of a gas mixture is shut off, and the intake valve is closed even when the camshaft rotates. More specifically, the cylinder deactivation apparatus (CDA) is connected to the HLA, and a hydraulic pressure is selectively applied to the HLA for thereby deactivating the cylinders.

When the cylinder deactivation apparatus (CDA) of the engine operates by a hydraulic pressure, an oil supply passage is necessary so as to supply oil to the cylinder deactivation apparatus (CDA). Further, the oil supply passage may be formed in a cylinder head or may be provided therein.

However, when the construction of the oil supply passage becomes complicated, the manufacture cost may increase, and more manufacture processes may be required, thus deteriorating manufacture efficiency. Further, if the oil supply passage fails to maintain an appropriate level of hydraulic pressure, the reactivity of the cylinder deactivation apparatus (CDA) may be deteriorated or error may occur during operations.

Therefore, what is needed is an oil passage for supplying oil with a simple construction, thereby keeping to a minimum the manufacturing costs the amount of amount of processes required to complete manufacture.

This information disclosed in this Background of the Invention section is only for enhancement of understanding of the general background of the invention and should not be taken as an acknowledgement or any form of suggestion that this information forms the prior art that is already known to a person skilled in the art.

BRIEF SUMMARY

Various aspects of the present invention are directed to providing an oil passage for supplying oil with a simple construction and to providing an oil passage for supplying oil where oil can be efficiently supplied to a cylinder deactivation apparatus (CDA).

In an aspect of the present invention, an oil passage for supplying hydraulic oil to a cylinder deactivation apparatus (CDA) that operates by a hydraulic pressure, may include a high pressure passage that is connected to an oil supply apparatus, wherein the high pressure passage receives high pressure oil from the oil supply apparatus and forms a high pressure, a low pressure passage that is fluidly-connected to the high pressure passage, wherein the low pressure passage receives pressurized oil from the high pressure passage and forms a low pressure relatively lower than the high pressure in the high pressure passage, wherein the low pressure passage is connected to the CDA to supply a hydraulic pressure to the CDA, and an orifice, wherein the orifice fluidly-connects the high pressure passage to the low pressure passage and communicates the high pressure passage and the low pressure passage, wherein the orifice supplies oil from the high pressure passage to the low pressure passage, and wherein the high pressure passage, the low pressure passage and the orifice are integrally formed in either a cylinder head or a cam carrier.

The orifice constantly maintains the low pressure in the low pressure passage.

The oil passage for supplying oil may further include a valve hole, wherein the valve hole is integrally formed in either the cylinder head or the cam carrier, and wherein the valve hole is positioned on an oil control valve, the oil control valve being opened and closed to selectively adjust an amount of oil supplied to the CDA.

The low pressure passage communicates with the valve hole to supply oil to the oil control valve.

The oil passage for supplying oil may further include a valve drain hole that communicates with the valve hole which is positioned on the oil control valve, wherein an amount of oil that is not supplied to the CDA by the control valve remains in the oil control valve and is configured to be drained, and wherein the valve drain hole is integrally formed in either the cylinder head or the cam carrier.

The oil passage for supplying oil may further include a drainage passage that is connected to the high pressure passage, wherein oil is configured to be drained from the high pressure passage through the drainage passage when the hydraulic pressure of the high pressure passage is higher than a predetermined value, and wherein the drainage passage is integrally positioned in either the cylinder head or the cam carrier.

The oil passage for supplying oil may further include a camshaft gallery including a first end and a second end and being formed in a circular shape, wherein the first end of the camshaft gallery is fluidly connected to an upper main gallery of the high pressure passage, and wherein the second end of the camshaft gallery is fluidly connected to the low pressure passage.

The oil passage for supplying oil may further include a connection gallery connecting a lower cross gallery connected to a lower main gallery, and an upper cross gallery connected to the upper main gallery, wherein the connection gallery maintains hydraulic pressures of a lower high pressure passage and an upper high pressure passage, and wherein the lower high pressure passage may include the lower main gallery and the lower cross gallery and the upper high pressure passage may include the upper main gallery, the upper cross gallery and the camshaft gallery.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
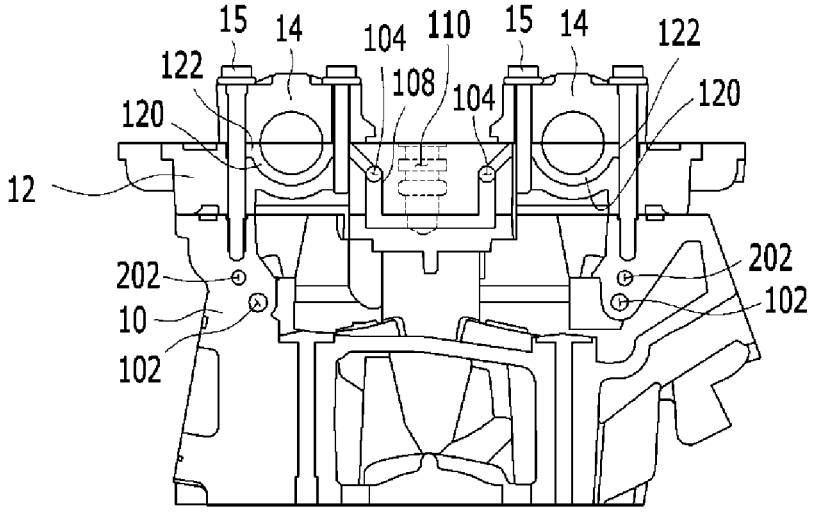
FIG. 1 is a cross-sectional view illustrating a cylinder head having an oil supply passage according to an exemplary embodiment of the present invention.

Reference numerals set forth in the Drawings include reference to the following elements as further discussed below:

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described with reference to the accompanying drawings so that those skilled in the Field of the Invention to which the present invention pertains may carry out the exemplary embodiment.

FIG. 1 is a cross-sectional view illustrating a cylinder head having an oil supply passage according to an exemplary embodiment of the present invention.

Figure 2:
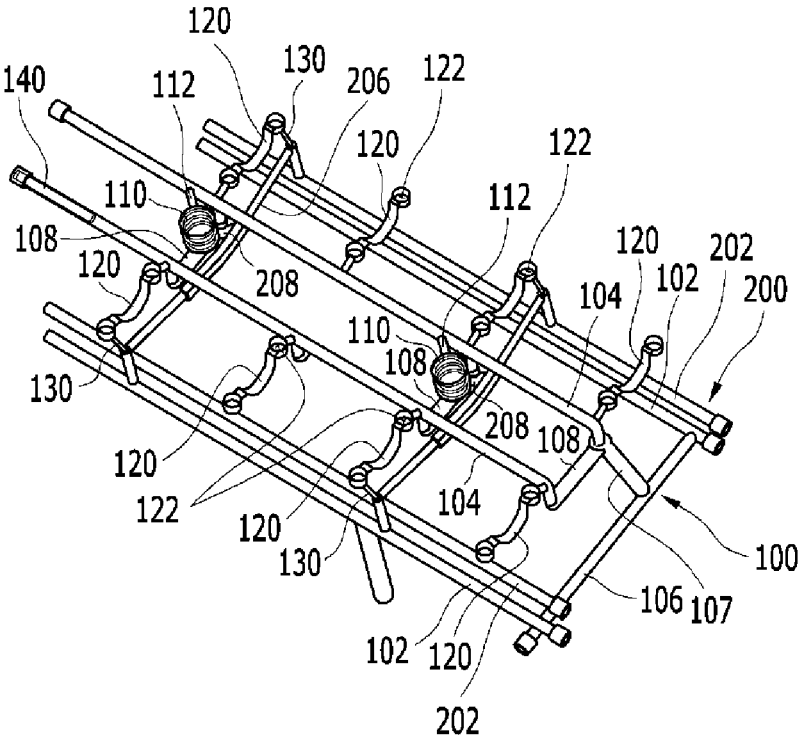
FIG. 2 is a perspective view illustrating an oil supply passage according to an exemplary embodiment of the present invention.
Figure 3:
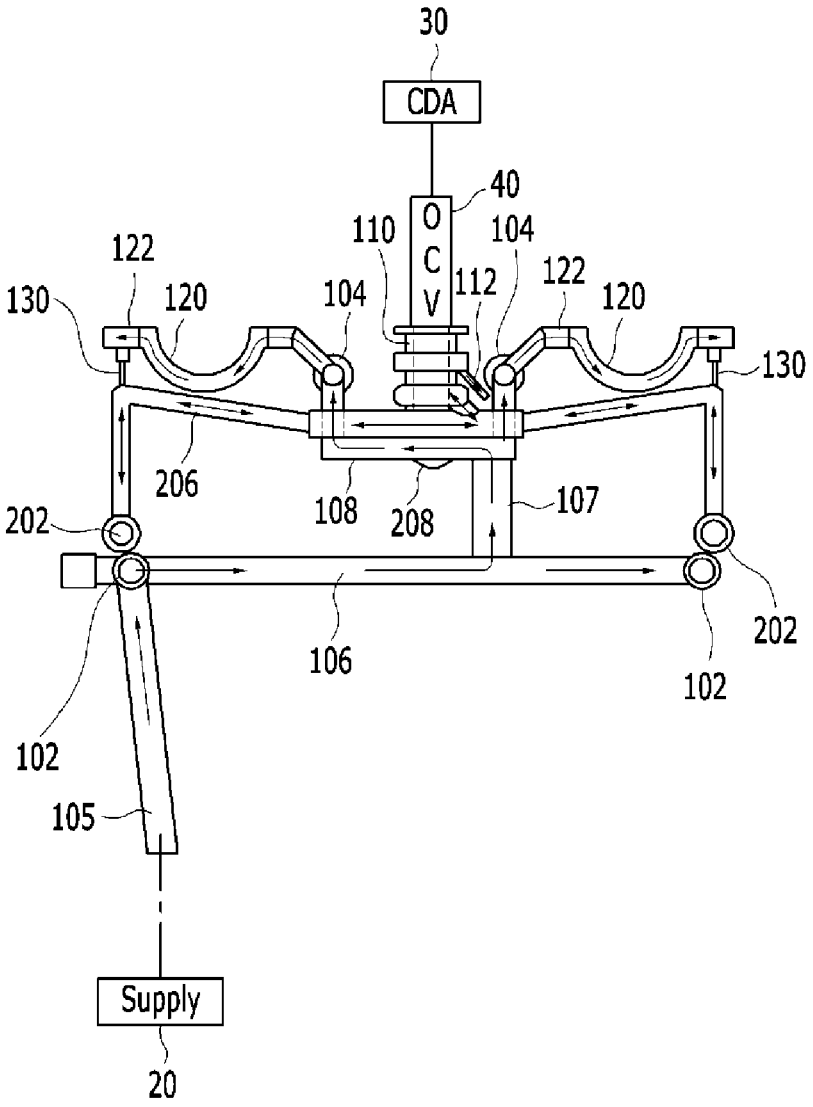
FIG. 3 is a front view illustrating an oil supply passage according to an exemplary embodiment of the present invention.
Figure 4:
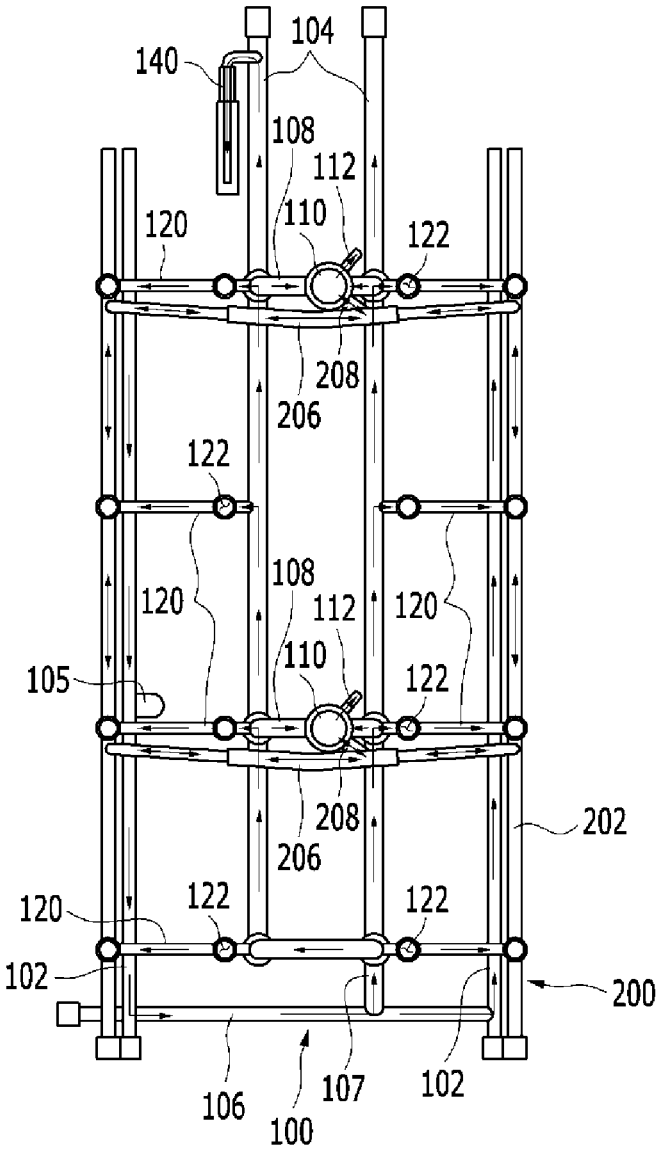
FIG. 4 is a top plan view illustrating an oil supply passage according to an exemplary embodiment of the present invention.

As illustrated in FIG. 1, an oil supply passage according to an exemplary embodiment of the present invention may be formed in both a cylinder head 10 and a cam carrier 12. As the cylinder head 10, the cam carrier 12 and the cam cap 14 are engaged with one another, the oil supply passage formed in both the cylinder head 10 and the cam carrier 12 may be a sealed passage. The cylinder head 10, the cam carrier 12 and the cam cap 14 may be engaged with one another by an engaging device 15 such as a bolt or any other similar engaging device FIG. 2 is a perspective view illustrating an oil supply passage according to an exemplary embodiment of the present invention. FIG. 3 is a front view illustrating an oil supply passage according to an exemplary embodiment of the present invention. FIG. 4 is a top plan view illustrating an oil supply passage according to an exemplary embodiment of the present invention.

As illustrated in FIGS. 2 to 4, the oil passage for supplying oil may include a high pressure passage 100 and a low pressure passage 200.

The high pressure passage 100 may be an oil passage that maintains a high pressure since it receives a high pressure oil with the aid of an oil supply apparatus 20 such as an oil pump, etc. in an air-tightness state.

The low pressure passage 200 may be an oil passage that maintains constant an internal hydraulic pressure since it receives oil from the high pressure passage 100 in the air-tightness state. The hydraulic pressure in the low pressure passage 200 is relatively lower than that in the high pressure passage 100.

The high pressure passage 100 may include a main gallery 102, 104, a cross gallery 106, 108, a supply gallery 105 and a connection gallery 107.

The main gallery 102,104 may be longitudinally arranged in a direction where a plurality of cylinders is positioned. The main gallery 102,104 may include a lower main gallery 102 and an upper main gallery 104.

In an aspect of the present invention, the lower main gallery 102 may be positioned in the cylinder head 10. The lower main gallery 102 may include two or more lower main galleries 102, the two or more lower main galleries 102 being positioned in parallel with each other. As illustrated in FIG. 2 and FIG. 4, two lower main galleries 102 are positioned in parallel with each other at both a first side and a second side of the cylinder head 10.

The upper main gallery 104 may be positioned in the cam carrier 12. The upper main gallery 104 may include two or more upper main galleries 104, the two or more upper main galleries 104 being positioned in parallel with each other. As illustrated in FIG. 2 and FIG. 4, two upper man galleries 104 are positioned in parallel with each other.

The cross gallery 106, 108 may be connected across the at least two main galleries 102 and 104 that may be longitudinally formed in a direction where a plurality of cylinders are positioned. The cross gallery 106, 108 may include a lower cross gallery 106 and an upper cross gallery 108.

The lower cross gallery 106 may be connected across at last two lower main galleries 102 that are arranged in parallel with each other. As illustrated in FIG. 2 and FIG. 4, a lower cross gallery 106 connects the two lower main galleries 102 but not limited thereto.

The upper cross gallery 108 may be connected across two or more upper main galleries 104 that are arranged in parallel with each other. As illustrated in FIG. 2 and FIG. 4, three upper cross galleries 108 connect the two lower main galleries 102.

Referring to FIGS. 3 and 4, the supply gallery 105 may be a passage through which to supply oil from the oil supply apparatus 20 to the high pressure passage 100. Further, the supply gallery 105 may be connected to either a lower main gallery 102 or a lower cross gallery 106 so as to supply oil to the high pressure passage 100. As illustrated in FIG. 3, the supply gallery 105 is connected to the lower main gallery 102.

The connection gallery 107 may be a passage that connects either the lower main gallery 102 or the lower cross gallery 106 or connects the upper main gallery 104 or the upper cross gallery 108. Further, the hydraulic pressures of the lower high pressure passage which includes the lower main gallery 102 and the lower cross gallery 106 and the hydraulic pressures of the upper high pressure passages including the upper main gallery 104 and the upper cross gallery 108 are maintained same by the connection gallery 107. As illustrated in FIG. 2 to FIG. 4, the connection gallery 107 connects the lower cross gallery 106 and the upper cross gallery 108.

The upper high pressure passage may further include a camshaft gallery 120 where the hydraulic pressure is also maintained by the connection gallery 107

The camshaft gallery 120 may be formed in an arch shape in whole to surround the lower surface of the camshaft. Further, both a first end and a second end of the arch-shaped camshaft gallery 120 may be formed in circular shapes. Both the first and the second ends of the camshaft gallery 120 may be formed in circular shapes because a passage can be formed where the engaging device 15 such as a bolt, etc. may be surrounded. That is, the engaging device 15 may be inserted and engaged into a hollow portion of the circular shape of the camshaft gallery 120. The hollow portion of the circular shape of the camshaft gallery 120 may be called a bolt through hole 122.

A first end portion of both the first end and the second end of the camshaft gallery 120 where the circular shape is formed may be connected to the upper main gallery 104. A second end portion of both the first and second ends of the camshaft gallery 120 where the circular shape is formed may be connected to the low pressure passage 200.

The low pressure passage 200 may include a low pressure main gallery 202, a low pressure cross gallery 206 and a low pressure supply gallery 208.

The low pressure main gallery 202 may be longitudinally formed in a direction where a plurality of the cylinders is arranged. The low pressure main gallery 202 may be formed in the cylinder head 10. In addition, the low pressure main gallery 202 may include at least two low pressure main galleries 202 that are parallel with each other. As illustrated in FIG. 2 and FIG. 4, two low pressure main galleries 202 are arranged in parallel at both the first and the second sides of the cylinder head 10.

The low pressure cross gallery 206 may be connected across at least two low pressure main galleries 202 that may be longitudinally formed in a direction where a plurality of the cylinders are arranged. As illustrated in FIG. 2 and FIG. 4, two low pressure cross galleries 206 connect two low pressure main galleries 202, but not limited thereto.

In an aspect of the present invention, the low pressure supply gallery 208 may be positioned in the low pressure cross gallery 206. Further, the low pressure supply gallery 208 may be a passage through which to supply oil to the cylinder deactivation apparatus (CDA) 30. The cylinder deactivation apparatus (CDA) 30 may be an apparatus that deactivates part of a plurality of the cylinders installed in an engine when the engine is in a low horse power state, which construction is well known to a person having ordinary skill in the art, so the descriptions thereon will be omitted. In particular, the oil passage for supplying oil is connected to supply hydraulic pressure to the cylinder deactivation apparatus (CDA) 30 when the cylinder deactivation apparatus (CDA) 30 operates by hydraulic pressure. Meanwhile, the hydraulic pressure of the low pressure passage 200 that is relatively lower than that in the high pressure passage 100 maintains a hydraulic pressure high enough to drive the cylinder deactivation apparatus (CDA) 30.

The low pressure cross gallery 206 is provided with more than the number of the cylinders that are deactivated by the operation of the cylinder deactivation apparatus (CDA) 30, and the low pressure supply gallery 208 is provided with the number of the cylinders that will be deactivated.

The oil passage for supplying oil may further include an orifice 130, a valve hole 110, a valve drain hole 112, and a drainage passage 140.

The orifice 130 may be a passage that connects the high pressure passage 100 and the low pressure passage 200. That is, the orifice 130 may be formed in the second end portion of both the first and second ends of the camshaft galley 120 connected to the low pressure passage 200 and may be connected to the low pressure cross galley 206 of the low pressure passage 200. The low pressure cross gallery 206 may extend upwards to be coupled to the second end portion of both the first and second ends of the cam shaft gallery 120 through the orifice 130 and then extends across the low pressure main gallery 202. Further, the orifice 130 may be formed to maintain constant the hydraulic pressure of the low pressure passage 200. The orifice 130 may channel oil from the high pressure passage 100 to the low pressure passage 200 when the hydraulic pressure of the low pressure passage 200 is lower than the predetermined hydraulic pressure, so the hydraulic pressure of the low pressure passage 200 rises to the predetermined hydraulic pressure and is maintained constant.

The orifice 130 may be a passage for oil so as to channel the flow of oil in such a way that part of the passage is made narrower, so the orifice passes oil with less resistance in liquidity as compared with its length. The definition and function of the orifice are known to a person having an ordinary skill in the art, so the descriptions thereon will be omitted.

In an aspect of the present invention, the orifice 130 that allows the low pressure passage 200 to constantly maintain low pressure may be integrally formed in the cylinder head 10, so it is possible to remove the constituent elements that were necessary when installing the orifice.

The valve hole 110 is a hole in which is positioned an oil control valve 40 that controls the amount of oil that is supplied to the cylinder deactivation apparatus (CDA) 30. That is, the low pressure supply galley 208 communicates with the valve hole 110 so as to supply hydraulic pressure to the oil control valve 40. The oil control valve 40 that is opened and closed so as to adjust the amount of oil that is supplied to the portions which need oil is known to a person having ordinary skill in the art, so the descriptions thereon will be omitted.

The valve drain hole 112 may be positioned at an end of the valve hole 110 and communicates with the valve hole 110. In addition, the valve drain hole 112 is formed to supply oil to the cylinder deactivation apparatus (CDA) 30 and to drain the oil remaining in the oil control valve 40.

The drainage passage 140 may be formed to drain the oil of the high pressure passage 100 when the hydraulic pressure of the high pressure passage 100 becomes excessively high. The oil drained through the drainage passage 140 may be supplied to the portions of a vehicle which need oil. For example, the oil drained through the drainage passage 140 may be used for the elements that are operatively provided in the engine and that need lubrication.

Referring to FIG. 3 and FIG. 4, the flow of the oil flowing through the oil passage for supplying oil is indicated by arrows.

In an aspect of the present invention, the oil that is supplied to the high pressure passage 100 through the supply gallery 105 flows through the galleries of the high pressure passage 100 connected so that the high pressure is uniformly formed in the high pressure passage 100. When the drainage passage 140 is selectively opened, part of the oil that moves through the galleries of the high pressure passage 100 can be drained.

The oil that is supplied through the orifice 130 from the high pressure passage 100 to the low pressure passage 200 flows through the galleries of the thusly connected low pressure passage 200 so that the low pressure can be uniformly formed in the entire portions of the low pressure passage 200. When the oil control valve 40 is selectively opened, part of the oil that flows through the galleries of the low pressure passage 200 is supplied to the cylinder deactivation apparatus (CDA) 30. Thus, a low pressure is uniformly formed in the entire portions of the low pressure passage 200 based on the function of the orifice 130 and is maintained.

In an aspect of the present invention, the construction of the oil passage for supplying oil can be simplified since the orifice 130 is integrally formed in the cylinder head 10 without adding elements that were necessary in the orifice. Further, the construction of the oil supply passages 100 and 200 is simple, so the manufacture cost may decrease, and the manufacture process may become simpler. Since a hydraulic pressure is constantly maintained in the low pressure passage 200, efficient and accurate oil supply can be obtained. Therefore, the reactivity can be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An oil passage for supplying hydraulic oil to a cylinder deactivation apparatus (CDA) that operates by a hydraulic pressure, the oil passage comprising:

a high pressure passage that is connected to an oil supply apparatus, wherein the high pressure passage receives high pressure oil from the oil supply apparatus and forms a high pressure;

a low pressure passage that is fluidly-connected to the high pressure passage, wherein the low pressure passage receives pressurized oil from the high pressure passage and forms a low pressure relatively lower than the high pressure in the high pressure passage;

wherein the low pressure passage is connected to the CDA to supply a hydraulic pressure to the CDA;

an orifice, wherein the orifice fluidly-connects the high pressure passage to the low pressure passage and communicates the high pressure passage and the low pressure passage;

wherein the orifice supplies oil from the high pressure passage to the low pressure passage; and wherein the high pressure passage, the low pressure passage and the orifice are integrally formed in either a cylinder head or a cam carrier;

a valve drain hole that communicates with a valve hole which is positioned on an oil control valve, wherein an amount of oil that is not supplied to the CDA by the oil control valve remains in the oil control valve and is configured to be drained; and wherein the valve drain hole is integrally formed in either the cylinder head or the cam carrier; and a drainage passage that is connected to the high pressure passage, wherein oil is configured to be drained from the high pressure passage through the drainage passage when the hydraulic pressure of the high pressure passage is higher than a predetermined value; and wherein the drainage passage is integrally positioned in either the cylinder head or the cam carrier.

2. The oil passage for supplying oil of claim 1, wherein the orifice constantly maintains the low pressure in the low pressure passage.

3. The oil passage for supplying oil of claim 1, further comprising:

the valve hole, wherein the valve hole is integrally formed in either the cylinder head or the cam carrier; and wherein the valve hole is positioned on the oil control valve, the oil control valve being opened and closed to selectively adjust an amount of oil supplied to the CDA.

4. The oil passage for supplying oil of claim 3, wherein the low pressure passage communicates with the valve hole to supply oil to the oil control valve.

5. The oil passage for supplying oil of claim 1, further comprising:

a camshaft gallery including a first end and a second end and being formed in a circular shape, wherein the first end of the camshaft gallery is fluidly connected to an upper main gallery of the high pressure passage; and wherein the second end of the camshaft gallery is fluidly connected to the low pressure passage.

6. The oil passage for supplying oil of claim 5, further comprising:

a connection gallery connecting a lower cross gallery connected to a lower main gallery, and an upper cross gallery connected to the upper main gallery.

7. The oil passage for supplying oil of claim 6, wherein the connection gallery maintains hydraulic pressures of a lower high pressure passage and an upper high pressure passage; and wherein the lower high pressure passage includes the lower main gallery and the lower cross gallery and the upper high pressure passage includes the upper main gallery, the upper cross gallery and the camshaft gallery.

* * * * *